US007396242B2

(12) United States Patent
Dekoski et al.

(10) Patent No.: US 7,396,242 B2
(45) Date of Patent: Jul. 8, 2008

(54) LEVER TYPE ELECTRICAL CONNECTOR

(75) Inventors: Kurt P. Dekoski, MaComb, MI (US); David M. Langolf, Ortonville, MI (US); Thomas Dolinshek, New Baltimore, MI (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/811,086

(22) Filed: Jun. 8, 2007

(65) Prior Publication Data

US 2007/0287310 A1 Dec. 13, 2007

Related U.S. Application Data

(60) Provisional application No. 60/811,943, filed on Jun. 8, 2006.

(51) Int. Cl.
*H01R 13/62* (2006.01)

(52) U.S. Cl. ..... 439/157

(58) Field of Classification Search ..... 439/157
See application file for complete search history.

(56) References Cited

U.S. PATENT DOCUMENTS 5,722,843 A * 3/1998 Kerckhof et al. ..... 439/157
6,368,125 B1 * 4/2002 Gundermann et al. ..... 439/157
6,854,992 B2 * 2/2005 Martin et al. ..... 439/157
6,881,081 B2 * 4/2005 Gundermann et al. ..... 439/157

* cited by examiner

*Primary Examiner*—Tho D Ta
(74) *Attorney, Agent, or Firm*—Larry I. Golden

(57) ABSTRACT

A lever-type electrical connector assembly is provided that includes first and second electrical connectors having an actuating lever movably mounted thereon for movement between a release position with the connectors un-mated and a lock position with the connectors mated. In one form, a blocking member is provided between the first connector and the actuating lever for holding the actuating lever in the release position. A second connector includes a release member for shifting the blocking member to allow the actuating lever to move from the release position to the lock position. In another form, the electrical connector assembly is configured to precisely maximize the mechanical advantage provided by the actuating lever by including a predetermined force transmitting engagement portion at which the lever actuator engages one of the connectors to transmit a concentrated, predetermined leveraged output force thereto upon pivoting of the lever from the release to the lock position.

2 Claims, 17 Drawing Sheets

LEVER TYPE ELECTRICAL CONNECTOR

CROSS-REFERENCE TO RELATED APPLICATION

This application claims benefit of U.S. Provisional Application No. 60/811,943, filed Jun. 8, 2006, which is hereby incorporated herein by reference in its entirety.

FIELD OF THE INVENTION

This invention generally relates to electrical connector assemblies and, more particularly, to an electrical connector assembly including electrical connectors that are matingly connected and disconnected by operation of a lever actuator of one of the connectors.

BACKGROUND OF THE INVENTION

A typical lever-type electrical connector includes an assembly of a first connector or housing and a second connector or header. To mate the connectors together, the assembly has an actuating or assist lever mounted for pivoting on the first connector with pivoting of the lever causing the first and second connectors to shift between unmated and fully mated configurations. To this end, the actuating lever and the second connector typically have a cam groove and a cam follower arrangement for drawing the second connector into mating condition with the first connector in response to pivoting of the lever. Such connectors are commonly used in the automotive industry; however, other uses are also possible.

A typical configuration for such lever-type electrical connectors is to provide a generally U-shaped lever structure having a pair of relatively thin walled lever arms that are disposed on opposite sides of the housing connector. The lever arms may have cam grooves for engaging cam follower projections or posts on opposite sides of the header assembly. These types of lever connectors are often used where relatively large forces are required to mate and unmate a pair of connectors. For instance, frictional forces encountered during connecting and disconnecting the connectors may make the process difficult to perform by hand. In some cases, relatively large electrical connectors with high pin counts, such as connectors with 90 or more pin contacts, require at least about 300 N to mate or un-mate the connectors. On the other hand, automotive industry standards specify a maximum of 75 N of user input force be required to perform this mating and unmating of the connectors.

It has been found that current lever-actuator configurations can not effectively mate or un-mate large connectors such as described above while keeping user input force at or below the level specified by the industry standard. With current lever connector configurations, the mechanical advantage provided by the lever actuators is not sufficient to overcome the high frictional forces seen by large electrical connector assemblies between pins and sockets of the connectors as they are mated and un-mated. At the interface between the cam projection and grooves, there are inefficiencies generated in the force transfer between the input force applied to the lever and the output force applied by the lever to the other connector requiring greater efforts by the user than as desired for mating and unmating the connectors together.

U.S. Pat. No. 6,099,330 to Gundermann et al. discloses an electrical connector assembly having a lever for mating and unmating electrical connectors. However, the connector of the '330 patent is disclosed as being used with a connector assembly with only 38 contacts, which is less than half the number of pin contacts employed in the large electrical connector assemblies described above. The configuration of the interface between the cam of the lever and the camming surface of the header electrical connector of the '330 electrical assembly connector is not suitable for larger connectors because the lever does not generate a sufficient mechanical advantage using only 75 N or less of input force to shift the connectors to a mated position relative to each other. The connector assembly in the '330 patent employs an assist lever with curved cam engagement surfaces. Such a curved surface does not provide a fixed contact location between the curved cam surface of the lever and cam surface area of the header connector as the lever is pivoted, but instead generates a rolling action in the cam surface area so that the leverage and output force generated by pivoting of the lever for mating the connectors together is variable. This makes precision design of such a lever to provide the mechanical advantage necessary for mating of large connector assemblies extremely difficult. In addition, the variable engagement of the curved cam force transmitting surfaces generates an inefficient transfer of forces therebetween. This variable and rolling engagement between the lever and cam surface area typically will not generate the concentrated, high levels of output forces (e.g., greater than 300 N) with relatively low actuator forces applied to the lever (e.g., 75 N or less).

In many cases, it can be necessary for the actuating lever to be locked in an initial or pre-mate position so that the actuating lever is properly aligned for assembly of the electrical connectors. By locking the lever in such a position, the connectors can be mated without having to reposition the actuating lever to this aligned position for connector mating. Current connector configurations, such as the lever design in the '330 patent, utilize a flexible or resilient portion on the lever itself at the ends of relatively thin arms thereof to lock the lever in the pre-mate position. In order to release the lever, the resilient end portions of the lever arms are flexed or bent away from their locked position so that the lever is free to pivot. Since the thin lever arms are used to generate the output force for mating and unmating the connectors, generally it is undesirable to have these lever arms be flexed or deformed during pivoting of the lever actuator.

Accordingly, there is a need for a lever actuator for an electrical connector assembly that generates a more efficient mechanical advantage, particularly with large electrical connectors that require the lever actuator to be able to generate large output forces without requiring large input actuator forces on the lever. In addition, a lever actuator that is not deformed as it is pivoted would be desired.

SUMMARY OF THE INVENTION

A connector assembly is provided that includes first and second electrical connectors for being mated together in electrical communication. In one aspect, an actuating lever is mounted to the first connector or housing for being shifted to mate the connectors together. The actuating lever has a predetermined first position with the connectors unmated and a predetermined second position with the connectors fully mated. The actuating lever includes a cam projection thereon and the second connector or header includes a corresponding cam groove. The cam projection is configured to engage the cam groove so that shifting of the actuating lever from the first position to the second position causes the connectors to fully mate with each other.

In one aspect, the connector assembly retains the actuating lever in the first position to generally align the cam groove and cam projection for connector assembly. That is, for example, the actuating lever is held against shifting from the first position during shipping and handling so that the lever is presented in the correct alignment for mating of the first and second connectors.

Preferably, the first connector includes a blocking portion for releasably retaining the actuating lever in the first position. The second connector includes a release portion. The release portion is operable to shift the blocking portion of the first connector to allow the actuating lever to be shifted from the first position to the second position.

In one form, the blocking portion includes a portion of the first connector wall to retain the lever in its first position. In another form, the blocking portion is a thin wall portion of the first connector. The blocking portion can be a resilient portion of the first connector. By providing the blocking portion on the first connector rather than on the actuator lever, requiring that the actuating lever be deformed during pivoting thereof for mating and un-mating of the connectors is avoided.

In another form, the connector assembly includes a pair of connectors that each has contacts adapted to frictionally engage each other to establish an electrical connection therebetween. The lever actuator of one of the connectors includes a force-input end for applying an actuation force thereto to pivot the lever actuator between a lock position with the connectors releasably locked together to secure the electrical connection between the contacts thereof and a release position with the connectors released from the locked position. A pivot connection is provided between the lever actuator and the one connector about which the lever actuator is pivotal.

The lever actuator includes a predetermined force transmitting engagement portion at which the lever actuator engages the other connector to transmit a leveraged output force thereto upon the pivoting of the lever actuator from the release position to the lock position. A first, fixed predetermined distance is provided between the force input end of the lever actuator and the pivot connection and a second, fixed predetermined distance is provided between the force transmitting engagement portion and the pivot connection that is smaller than the first, fixed predetermined distance. A fixed, predetermined leverage ratio is defined by dividing the larger, first fixed predetermined distance by the smaller, second fixed predetermined distance. This leverage ratio stays substantially constant during pivoting of the lever actuator from the release position to the lock position. In this manner, with a constant actuation force applied to the force input end of the lever actuator, a known constant output force will be generated on the other connector allowing for a more precise force transfer system to be designed for the connector assembly herein.

In this regard, an electrical connector assembly is provided that is configured to precisely maximize and concentrate the mechanical advantage provided by the actuating or assist lever. It is preferred that the connector assembly be configured to provide an output force of at least about 300 N with a user input force of only about 75 N or less on a force-input end of the actuating lever. The connectors herein, therefore, are able to generally comply with automotive industry standards because lower levels of input forces can be used to mate even large connectors, such as those with at least 90 pin contacts.

The constant leverage ratio can be precisely set via the fixed distances along the lever actuator to provide a large output force that is achieved with lower levels of actuation force being applied to the force-input end of the lever by the user. In one form, the predetermined leverage ratio is approximately 7:1. In another form, the predetermined leverage ratio is sufficient to achieve the leveraged output force of approximately 300 N or greater with the actuation force being approximately 75 N or less.

This substantially constant leverage ratio is in contrast to the variable leverage ratios provided by the previously discussed electrical connector assembly of the '330 patent. Prior lever-assist systems can include curved engagement portions between corresponding cam areas on the lever and connector that generally form a variable or rolling engagement between the lever and connector to provide a variable output force. This makes it difficult to precisely know what output force will be generated by a specific actuation force on the lever, and causes a less efficient transfer of forces since there is no discrete line of contact at the engagement interface that stays constant during pivoting of the lever actuator. The connectors herein, on the other hand, provide a discrete and constant engagement interface between the cam projection and cam groove to provide constant leveraged mating or un-mating output forces with the same actuation force on the lever.

In one form, the lever actuator includes a distal end opposite the force input end. The force transmitting engagement portion of the lever actuator is a protrusion at the distal end of the lever actuator. The other connector has a pocket that includes a drive surface against which the protrusion of the lever actuator engages for causing the connectors or slide in a linear direction relative to each other upon pivoting of the lever actuator. Herein, when discussing shifting or sliding of the connectors relative to each other, this should be understood to include an arrangement where one connector is fixed, such as the connector with the lever, and where only the other connector shifts or slides.

In one preferred form, the pocket can include corner surfaces with one of the corner surfaces being the drive surface. The lever actuator distal end further includes an undercut corner area adjacent the protrusion to provide clearance so that only the protrusion of the lever actuator distal end engages the pocket drive surface to transmit the leveraged output force thereto as the lever actuator is pivoted from the release position to the lock position.

In another form, the pocket includes an abutment surface that is opposite the drive surface across the pocket. The abutment surface extends generally orthogonal to the linear direction, so that with the lever actuator in the release position, relative linear sliding of the connectors toward each other to allow the lever actuator to lock the connectors together causes the lever actuator distal end to engage against the abutment surface without causing pivoting of the lever actuator toward the lock position thereof. In this regard, the lever actuator has a robust release position in that the lever actuator is not pivoted from its release position by sliding of the connectors together prior to user operation of the lever actuator. This is in contrast to the connector assembly of the previously discussed '330 patent where sliding the connectors together causes the lever to pivot from the corresponding release position without any user input actuator force applied thereto.

In another form, the lever actuator also may include two additional predetermined force transmitting engagement portions that sequentially engage and transmit a dual-stage leveraged output force to the other connector. In an initial stage, a high level of output force is generated, and in a subsequent stage, a lower level of output force is generated. These high and low levels of output force are generated independent of the user as such varying level of output forces are obtained with the same actuation force being applied to the force input end to pivot the lever actuator from the locked position to the release position.

The two additional predetermined force transmitting engagement portions may be at different fixed, predetermined distances from the pivot connection to provide two different predetermined leverage ratios. These two different predetermined leverage ratios both stay substantially constant during the corresponding stages of pivoting of the lever actuator from the locked position to the release position. In one form, the first predetermined distance provides for a leverage assist ratio of at least about 8:1 and the second predetermined distance provides for a leverage assist ratio of at least about 5:1.

DETAILED DESCRIPTION OF THE PREFERRED EMBODIMENTS

Figure 1:
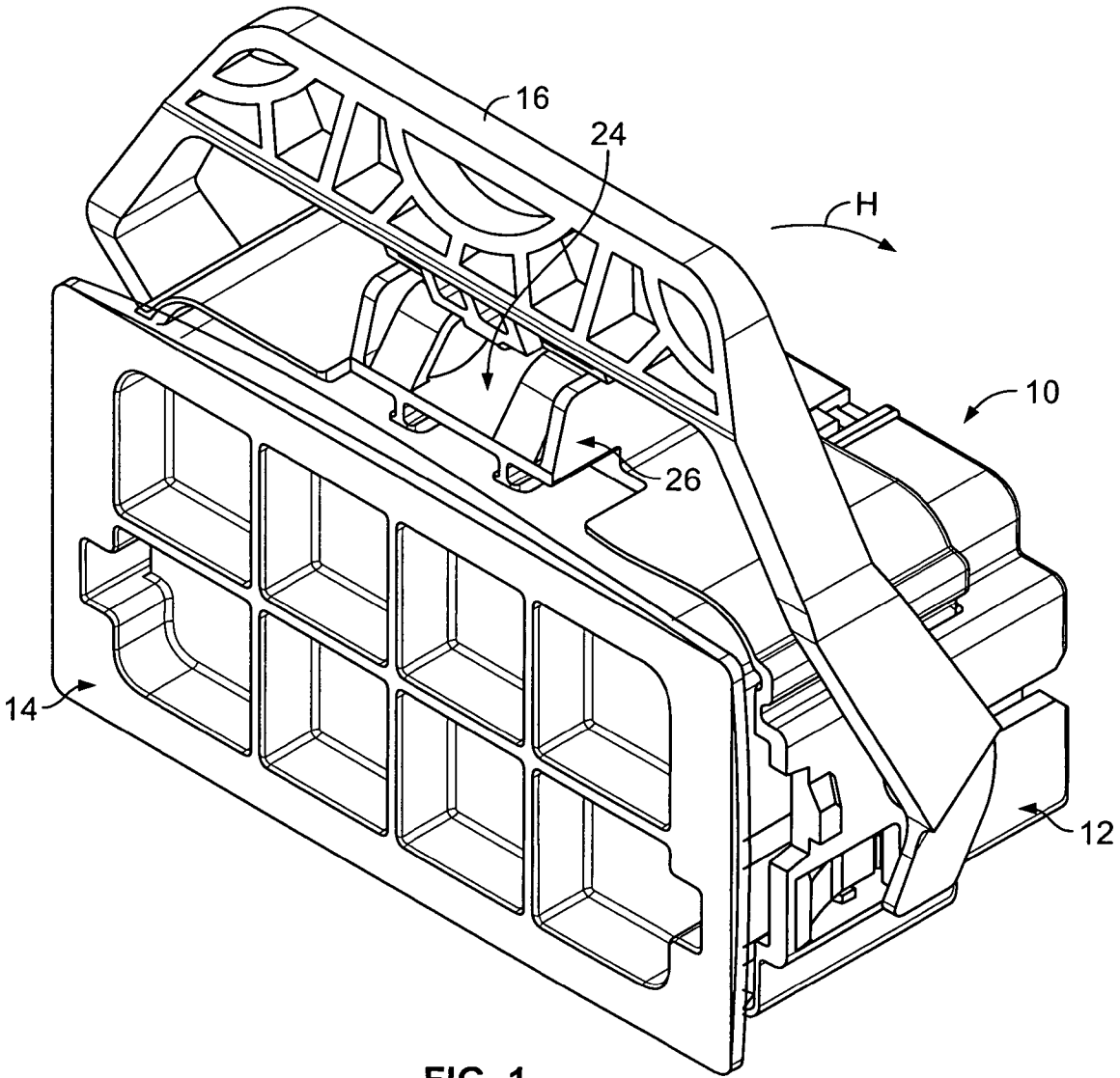
FIG. 1 is a perspective view of a lever connector assembly including a first and second connector shown in an locked or mated configuration with an actuating lever in a locked or second position.
Figure 2:
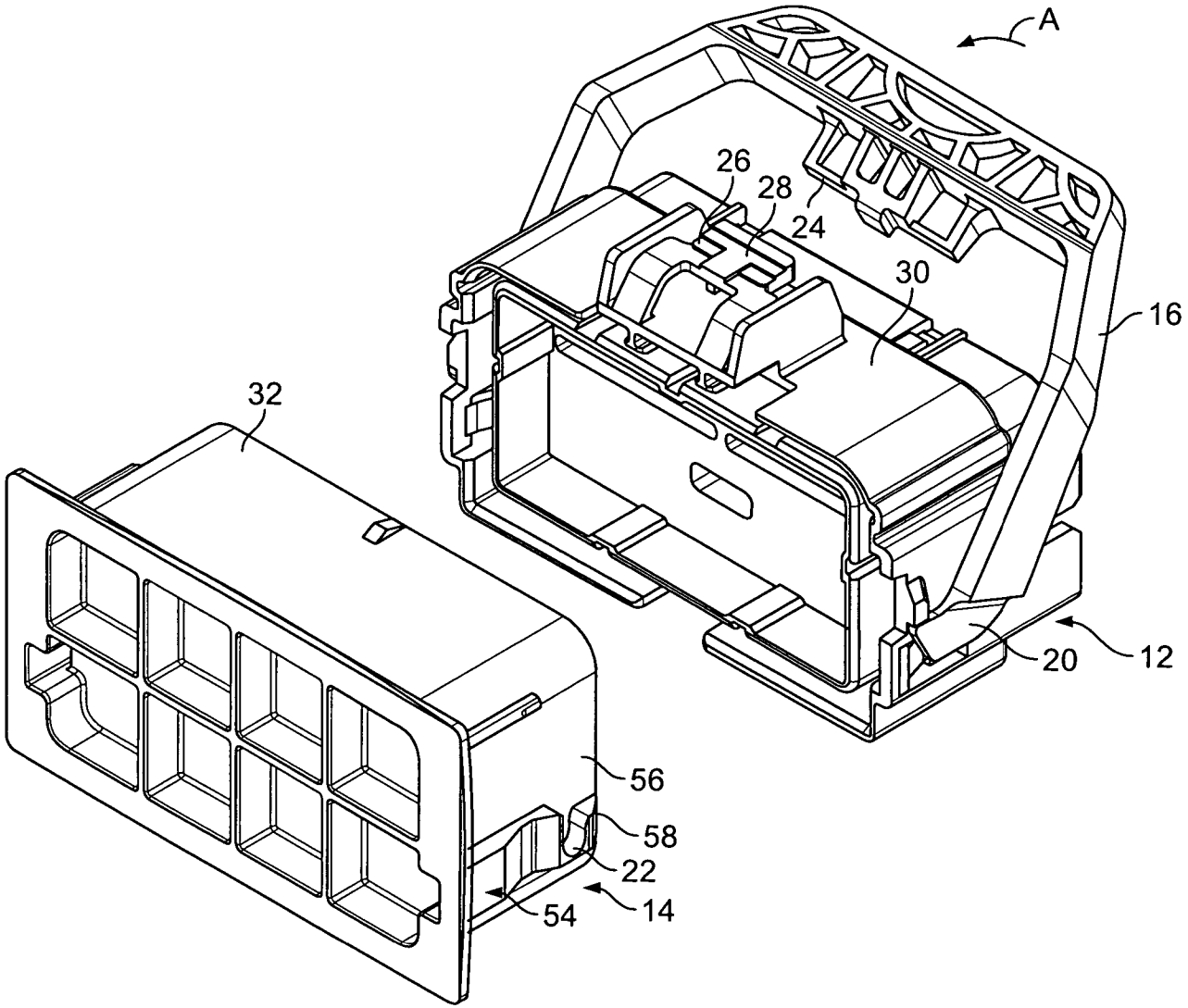
FIG. 2 is an perspective view of the lever connector shown in an unassembled configuration with the actuating lever in a pre-mate or first position.

Referring to the drawings in greater detail, and first to FIGS. 1 and 2, a lever-type electrical connector assembly 10 is illustrated that includes a first connector or housing 12 and a second connector or header 14. Each connector 12 and 14 includes a plurality of electrical contacts (not shown) received therein. Preferably, the assembly 10 includes greater that 90 electrical contacts and, when assembled, is at least 70 mm wide, 60 mm long, and 60 mm high. In one preferred example, the connector 10 may include 98 electrical contacts and be configured as a harness connector for diesel engines; however, other uses, sizes, and configurations of the connector 10 are also possible.

Connectors of such size and configuration typically require greater than about 300 N of force to overcome frictional and engagement forces in order to mate or un-mate the header 14 and the housing 12. To this end, the connector 10 further includes a lever actuator 16 having a first, pre-mate, or release position (FIG. 2) and a second, mated, or lock position (FIG. 1). The lever actuator 16 is arranged and configured to linearly urge or advance the second connector 14 into a mating relationship with the first connector 12 upon the lever actuator 16 being shifted or pivoted from the pre-mate position of FIG. 2 to the mated position of FIG. 1. As further described below, the connectors 12 and 14 and the lever 16 are configured for efficiently mating the larger size connectors as described above. The lever 16 is generally more robust than prior levers to maximize the mechanical advantage thereof with little or no wasted input force to overcome play in the pivoting of the lever.

Figure 3:
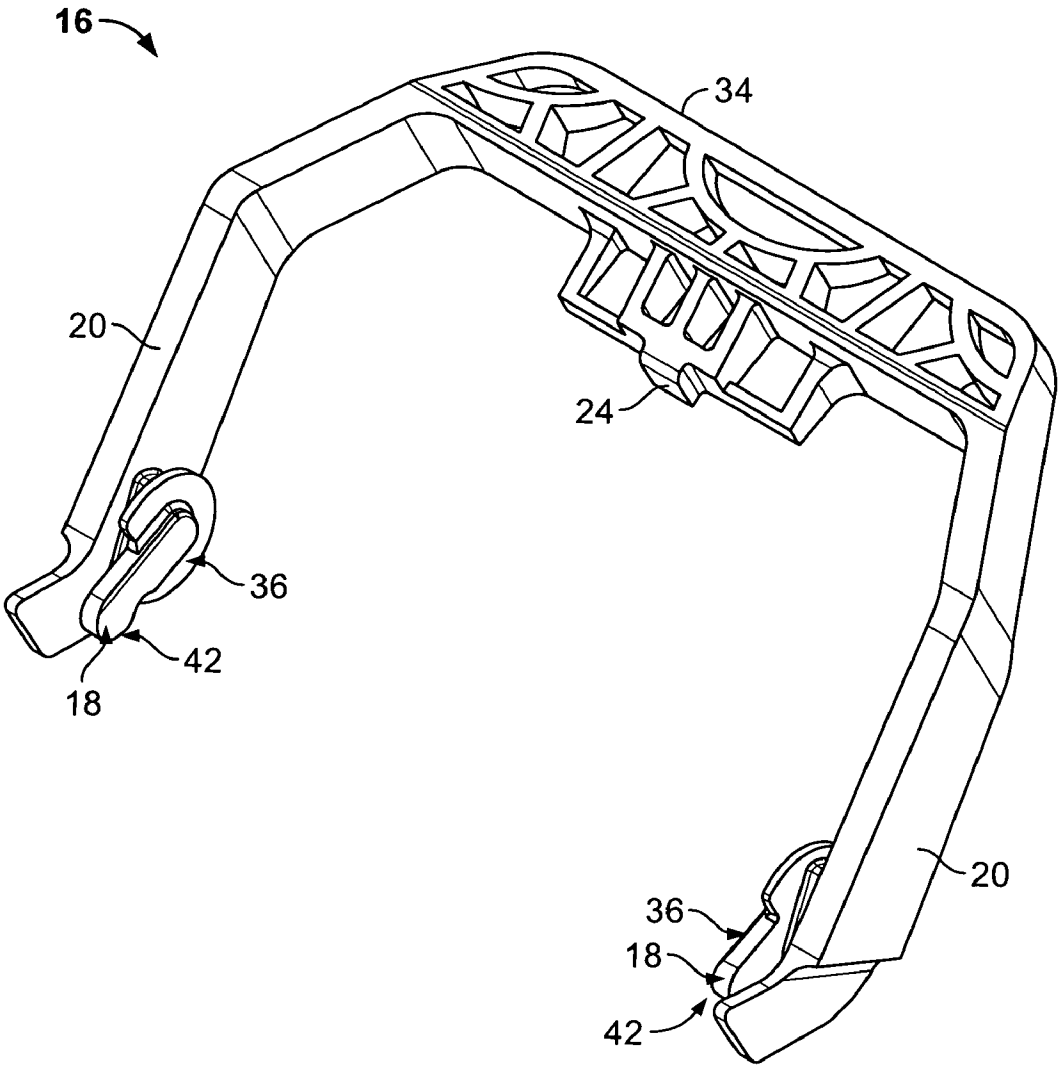
FIG. 3 is a perspective view of the actuating lever showing a force input end and a cam projection including at least one predetermined force transmitting engagement portion thereof.

More specifically, referring to FIGS. 2 and 3, to effect such mating, the lever actuator 16 includes a cam projection 18 on an actuating end 20 thereof that is configured to engage a cam groove 22 positioned on the header 14 so that shifting of the lever actuator 16 from the first to the second position causes the connectors 12 and 14 to linearly advance to be fully mated with each other. When fully mated, the lever 16 includes a latch member 24 thereon that cooperates with a locking member 26 positioned on the housing 12 to lock the lever 16 in the mated position. The locking member 26 blocks reverse movement of the lever 16. To release the lever 16 from the mated position, a resilient release tab 28 on the locking member 26 is depressed and biased downwardly to permit free movement of the lever 16.

Referring again to FIG. 2, the connector assembly 10 generally includes male and female connector portions. For example, the first connector 12 is formed from a wall 30 that defines a generally rectangular housing for the electrical contacts (not shown) of a female connector. The second connector 14 is formed from a corresponding wall 32 that also defines a generally rectangular header for corresponding electrical contacts (not shown) to form a male connector that is receivable in the female connector. Manifestly, the first connector 12 can be a male connector and the second connector 14 can be a female connector. As shown, the lever 16 is mounted to the first connector 12 and arranged to shift or pivot from the pre-mate to the mated connector in the direction of arrow A.

Figure 4:
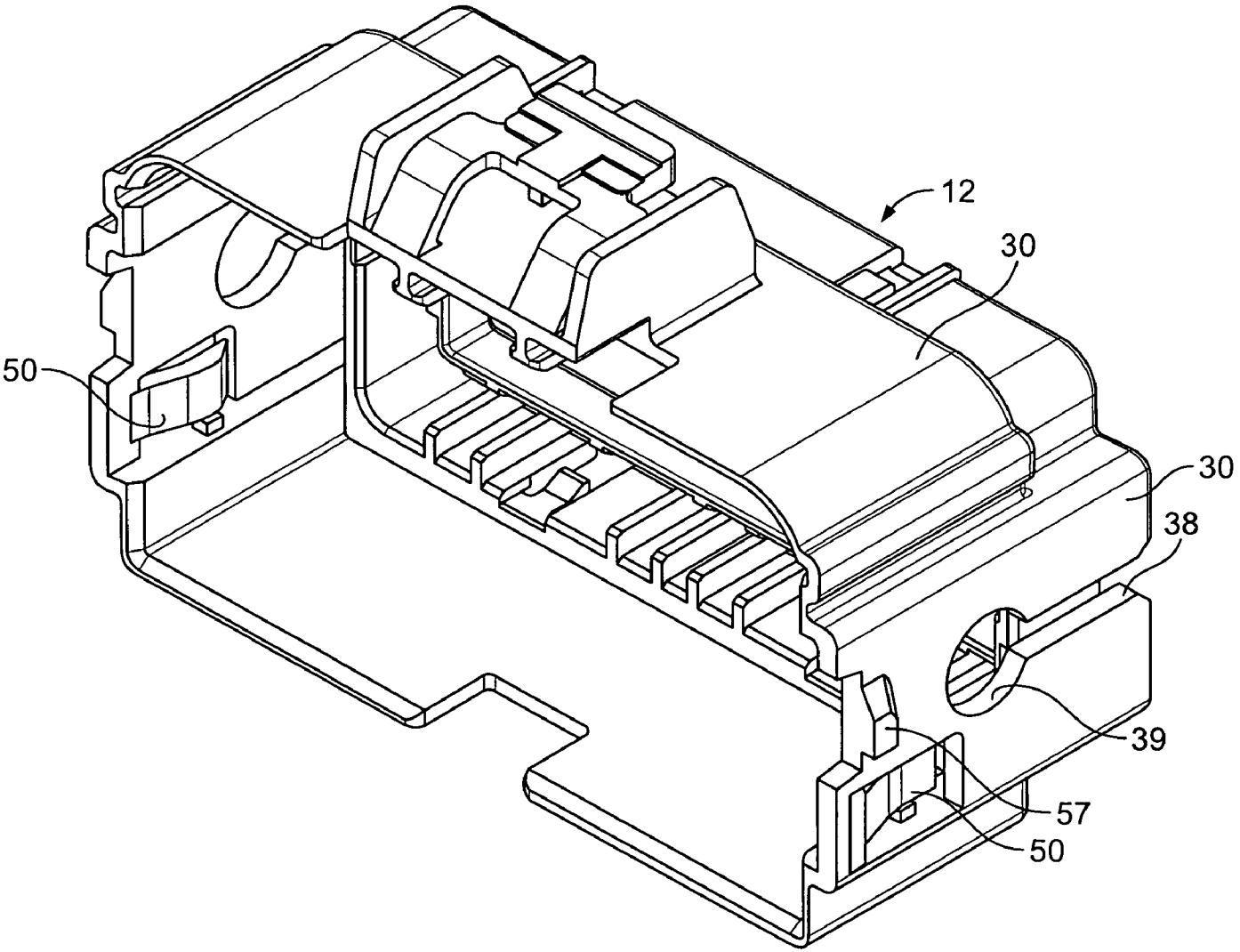
FIG. 4 is a perspective view of the first or housing connector showing a blocking portion thereof formed from a resilient tab or a thin wall portion of the first connector, the blocking portion for blocking shifting of the actuating lever in a mating direction.

Referring to FIGS. 3 and 4, the lever actuator 16 is a generally "U" shaped structure having a pair of end portions 20 and a center connecting portion 34 that connects the two end portions. Each end portion 20 includes a pivot element 36 and the cam projections 18. The center connector portion 34 further includes the previously described latch 24.

The lever 16 is pivotally mounted to the first connector 12 by the pivot element 36 being received in a key-hole slot 38, and in particular, a pivot opening 39 formed in a side wall portion 40 of the first connector wall 30. The pivot element 36 and pivot opening 39 allow for pivotal movement of the lever 16. As further discussed below, the cam projection 18 includes one or more discrete predetermined force transmitting engagement portions 42 that are configured to transmit a leveraged force upon pivoting of the lever 16 to either mate or un-mate the first connector 12 and the second connector 14.

Figure 5:
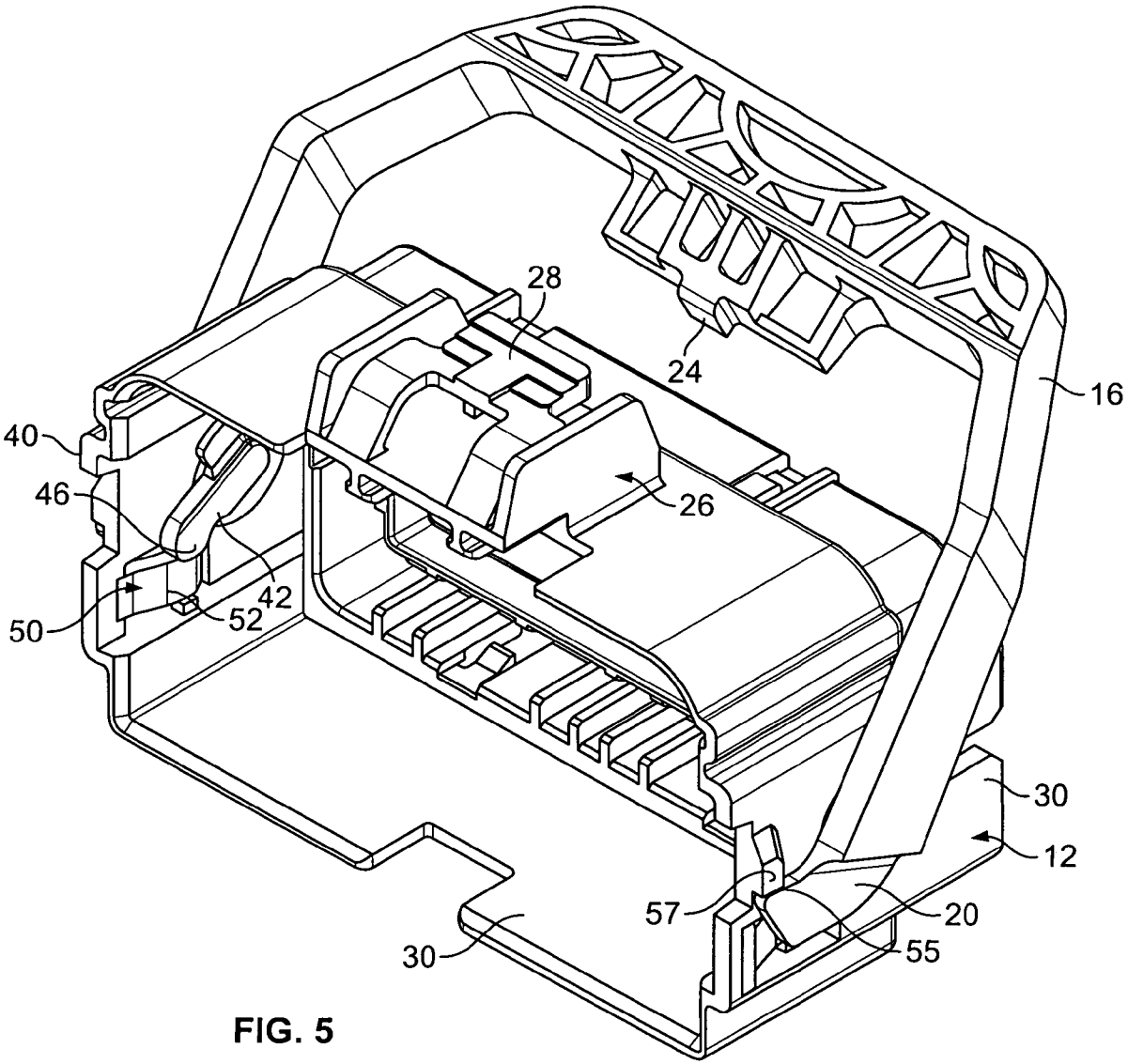
FIG. 5 is a perspective view of the first or housing connector showing the actuating lever in the first or pre-mate position and being blocked from shifting by engagement with the blocking portion of the first connector.
Figure 6:
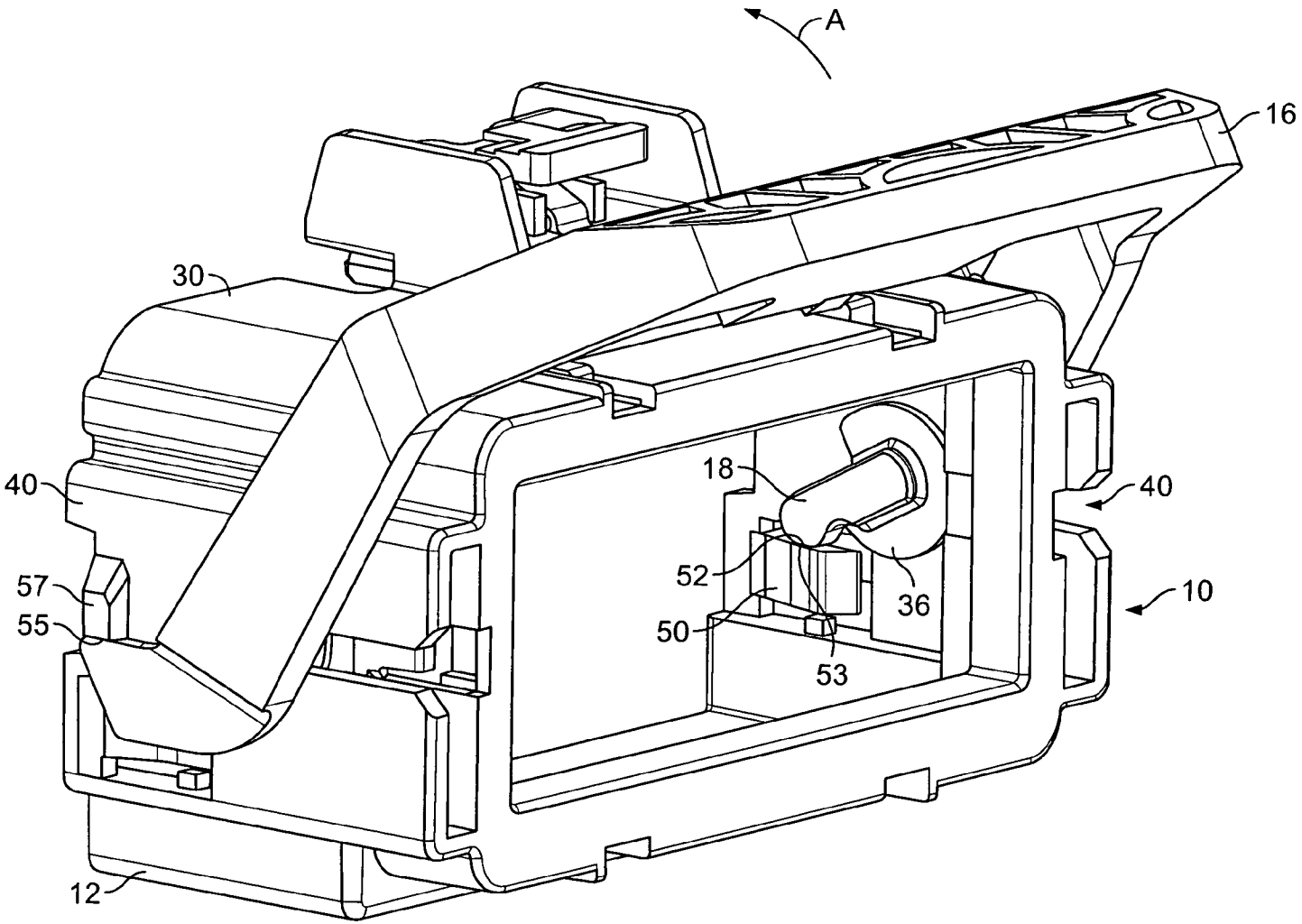
FIG. 6 is another perspective view of the first or housing connector showing the lever in the first or pre-mate position with a flat portion of the lever cam projection engaging the blocking portion of the housing wall.
Figure 7:
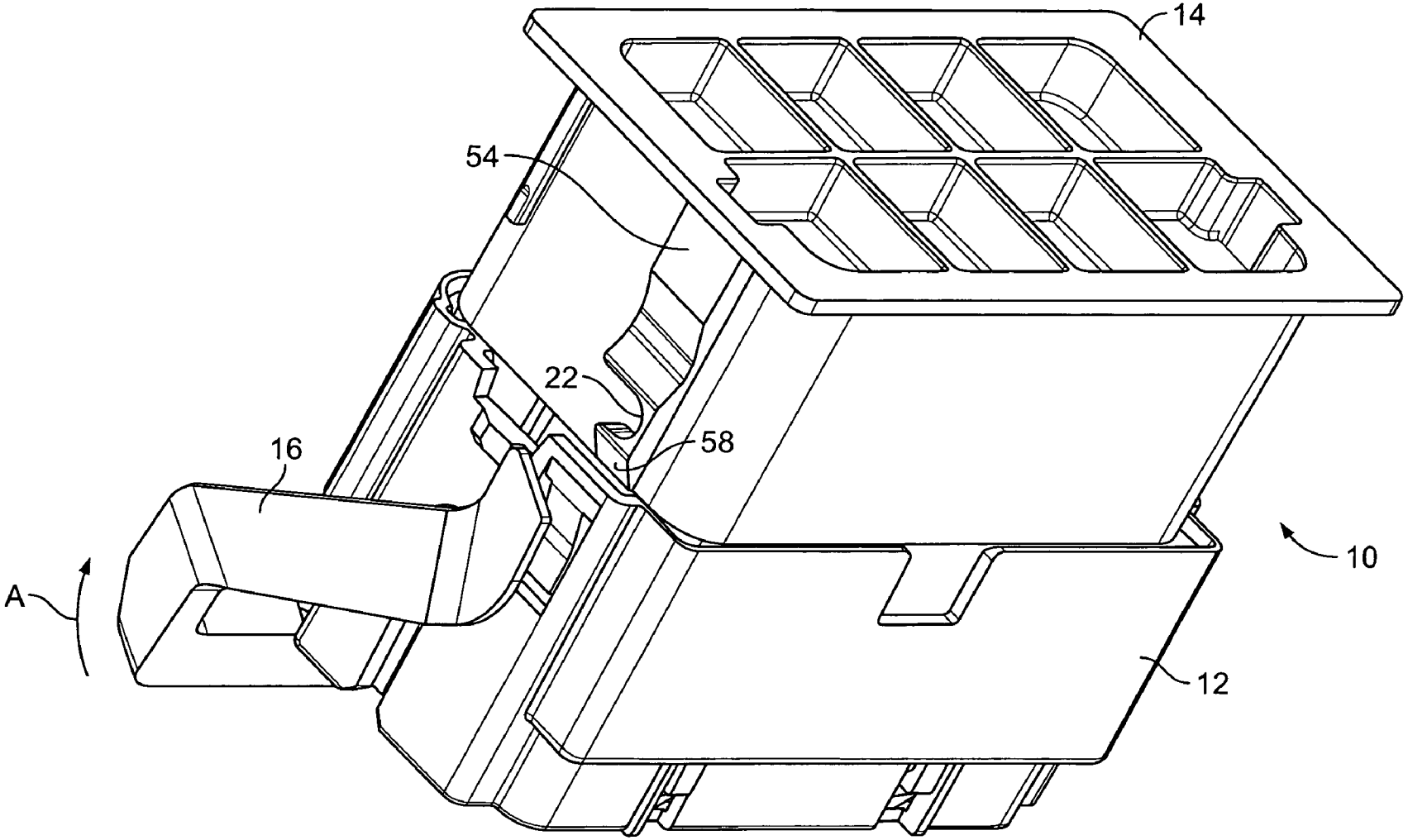
FIG. 7 is a perspective view of the connector assembly prior to mating showing the first connector being initially inserted into the second connector.

The connector assembly 10 includes an engagement system for retaining the actuating lever 16 in the pre-mate position to minimize any re-alignment prior to mating the connectors. To this end, the engagement system blocks shifting of the lever 16 in the mating direction A via a blocking portion 50 of the first connector housing wall 30. Preferably, the blocking portion 50 is in the form of a resilient lever stop projection or tab that extends inwardly to a cavity formed by the first connector housing wall 30 as best illustrated in FIGS. 4, 5, and 6. In one form, the blocking portion 50 includes a thin wall extension or a resilient tab 52 that extends inwardly to the cavity formed by the connector wall 30. The blocking portion 50 is configured to prevent shifting of the lever 16 in direction A (FIG. 2) when in the pre-mate position. As best shown in FIGS. 5 and 6, such blocking is accomplished when the blocking portion 50 is in its first, unbiased position because a flat portion 52 of the cam projection 18 abuts an upper surface 53 of the lever stop projection 50. This arrangement blocks or interferes with movement of the cam projection 18 and substantially prohibits any pivoting of the actuating lever 16 in a mating direction A.

As also shown in FIG. 6, when the lever 16 is in the first or pre-mate position, it is also blocked from reverse shifting through engagement of an upper surface 55 of the lever end 20 against a projecting tab 57 on the first connector side wall 30. As a result, in the pre-mate position, the lever is restrained from both forward and reverse movement because it is captured between the blocking portion 50 and the projecting tab 57.

Referring again to FIG. 2, the housing wall 32 of the second connector 14 preferably includes a release portion 54 that extends outwardly from a side wall portion 56 of the second connector wall 32. The release portion 54 is positioned so that upon the second connector 14 being inserted into the first connector 12, the release portion 54 shifts the blocking portion 50 from its blocking or first position to a clearance or second position to permit movement of the lever 16. To this end, the release portion 54 includes a lead-in cam surface 58 at the front of the release portion 54 that is configured to cammingly engage the blocking portion 50 and shift it to the clearance position upon the second connector 14 being initially inserted into the first connector 12.

Figure 11:
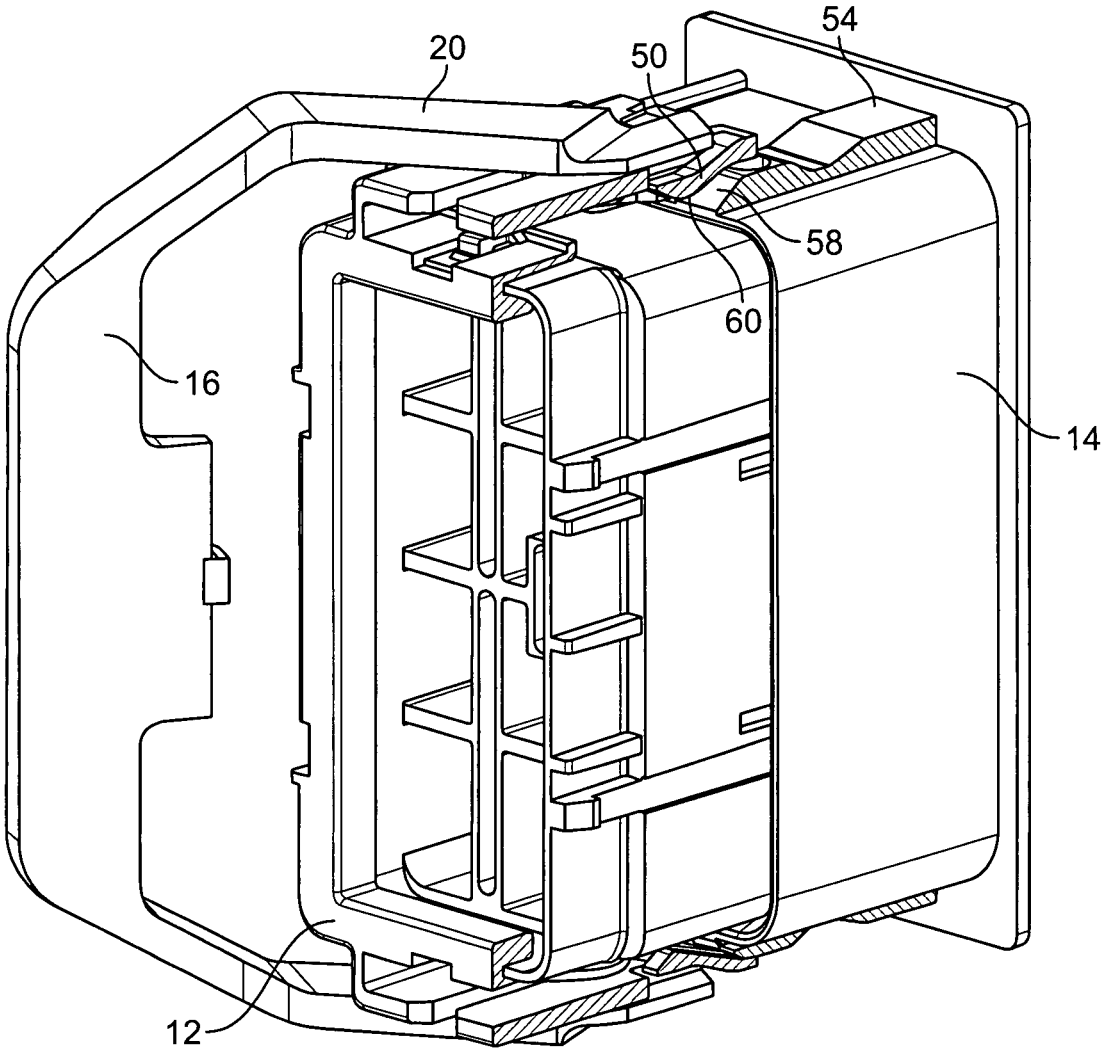
FIG. 11 is a partial cross-sectional view of the connector assembly during the initial mating of the connectors showing the leading cam surface of the second connector release portion engaging the blocking portion of the first connector.
Figure 12:
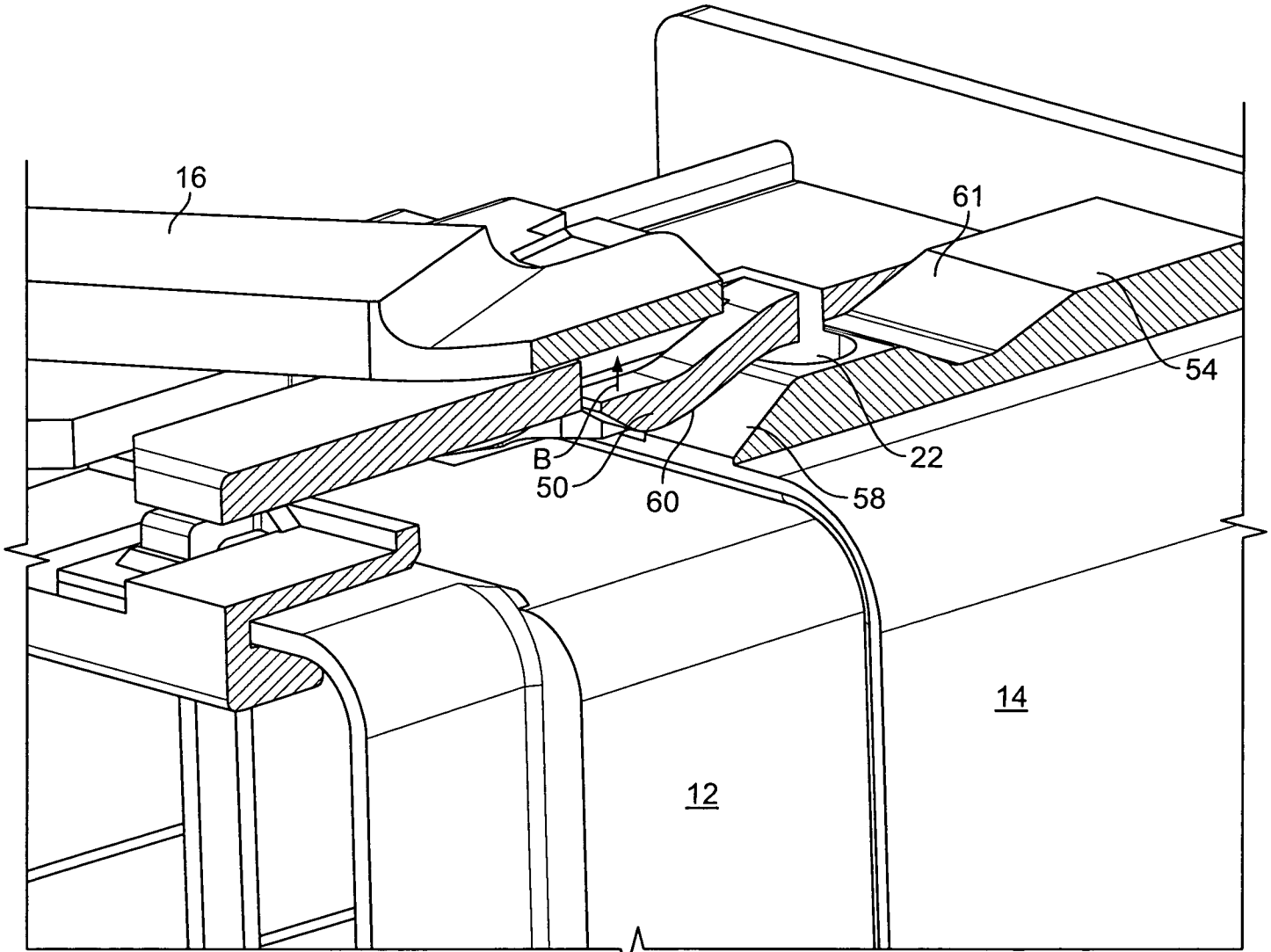
FIG. 12 is an enlarged, partial cross-sectional view of the connector assembly of FIG. 11 showing the leading cam surface of the second connector release portion engaging the blocking portion of the first connector to resiliently shift the blocking portion to allow the actuating lever to be shifted from the pre-mate to the mated position.

More specifically, to release the actuating lever 16 and allow pivotal movement thereof in direction A to fully mate the connectors 12 and 14, the second connector 14 is brought into initial engagement with the first connector 12 to release the blocking portion 50 as best illustrated in FIGS. 7-12. Upon the initial insertion of the connectors 12 and 14, the release portion 54 on the second connector 14 enters the first connector 12 and the lead-in cam surface 58 of the release projection 54 shifts or deflects the resilient lever stop projection 50 out of engagement with the flat portion 42 of the cam projection 18 and, therefore, allows the lever actuator 18 to be pivoted in the mating direction A. To this end, as best illustrated in FIGS. 11 and 12, the lead-in cam surface 58 is inclined so that it cammingly engages a corresponding cam surface 60 on the blocking portion 50 to resiliently shift the blocking portion outwardly in the direction of arrow B (FIG. 12). Once the blocking portion 50 is shifted to the clearance or second position, the lever 18 is free to shift or pivot in the mating direction A (FIG. 2) to linearly advance the second connector 14 into a mating relationship with the first connector 12.

Figure 8:
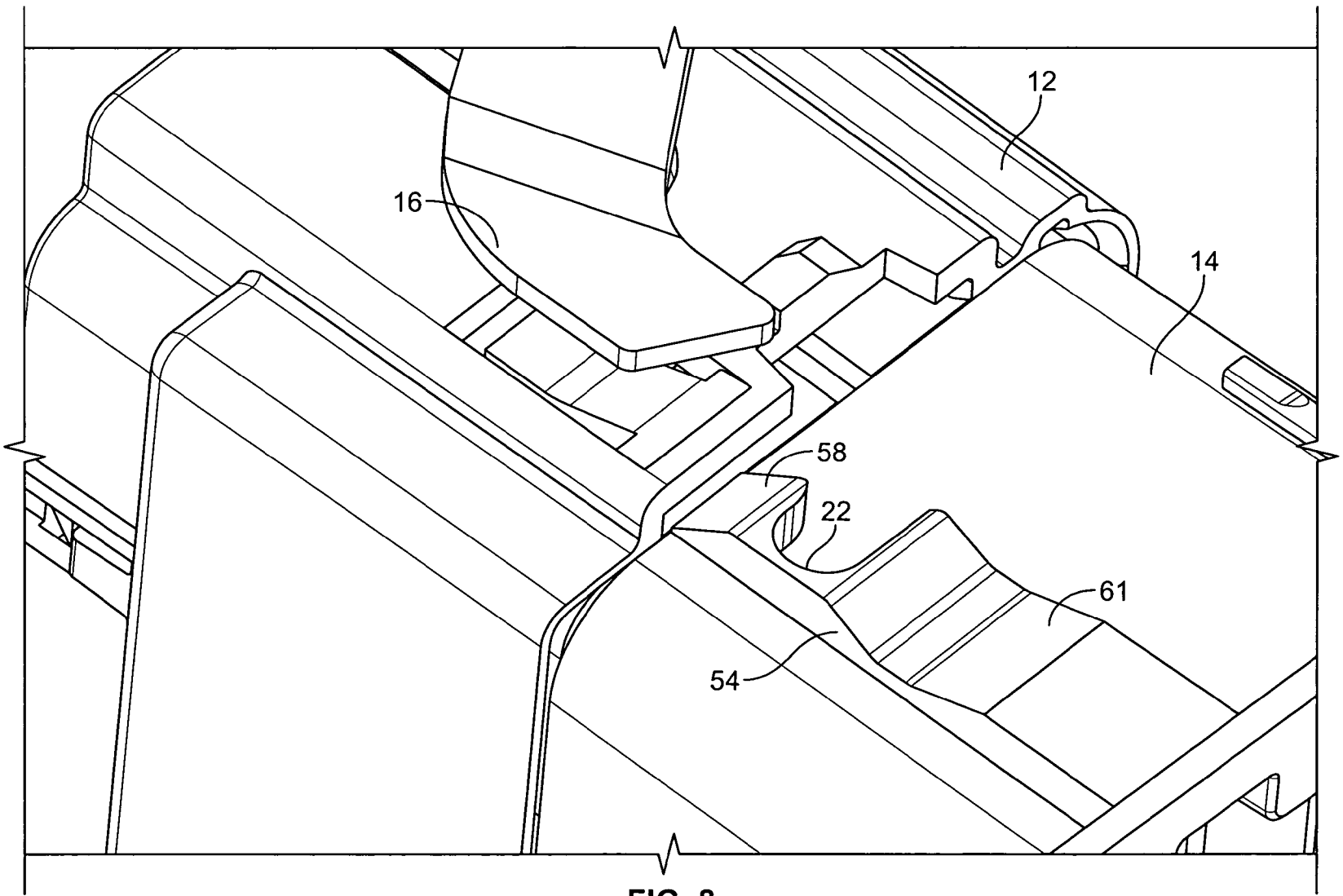
FIG. 8 is an enlarged perspective view of the connector assembly in the initial positioning of FIG. 7 showing a releasing portion of the second connector and a leading cam surface thereof for cammingly engaging the blocking portion for shifting the blocking portion from its blocking position to a release position.
Figure 9:
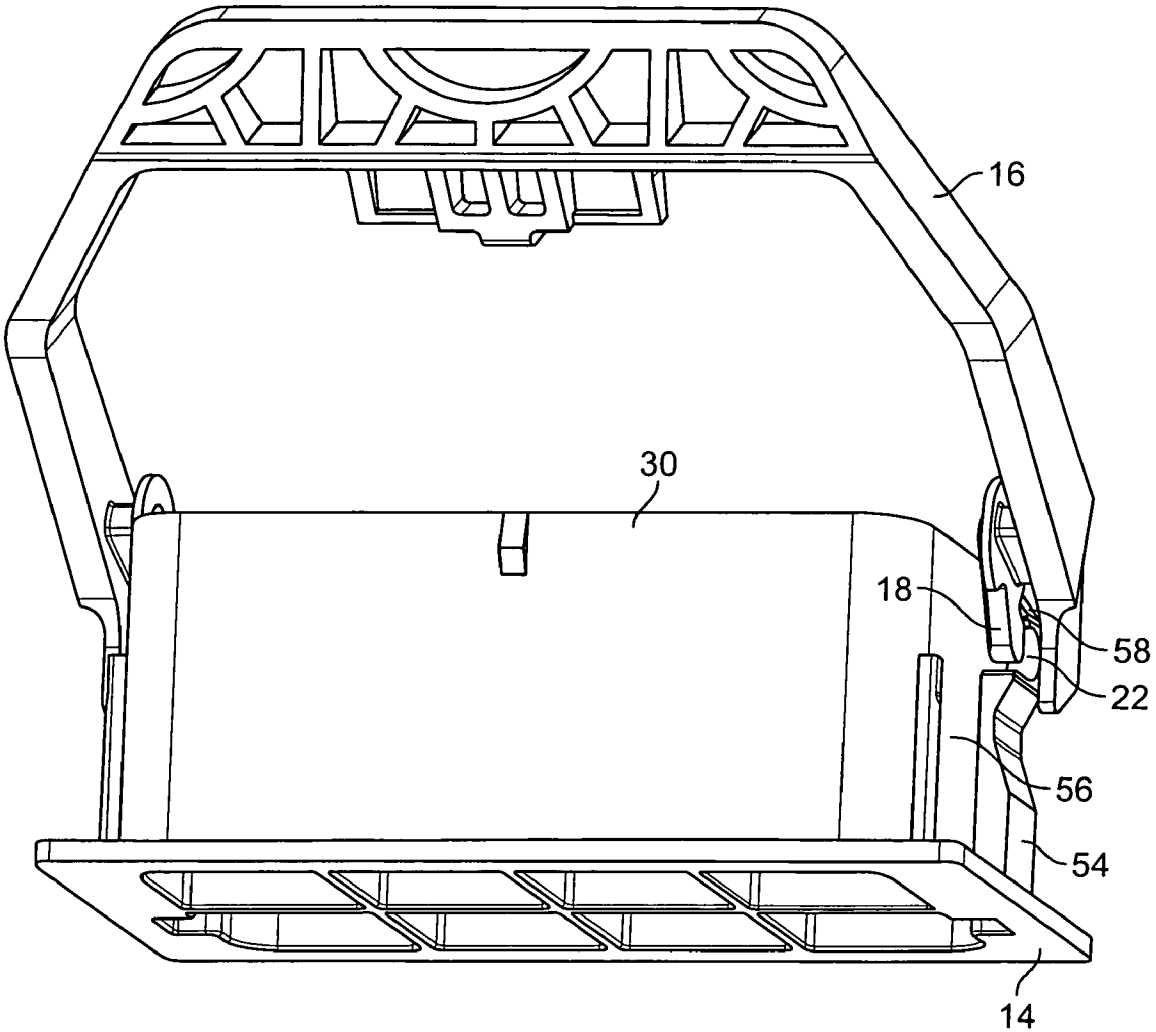
FIG. 9 is a perspective view of the second connector and the actuating lever in the pre-load position showing the relationship of the cam projection relative to the release portion, the first connector being removed for clarity.
Figure 10:
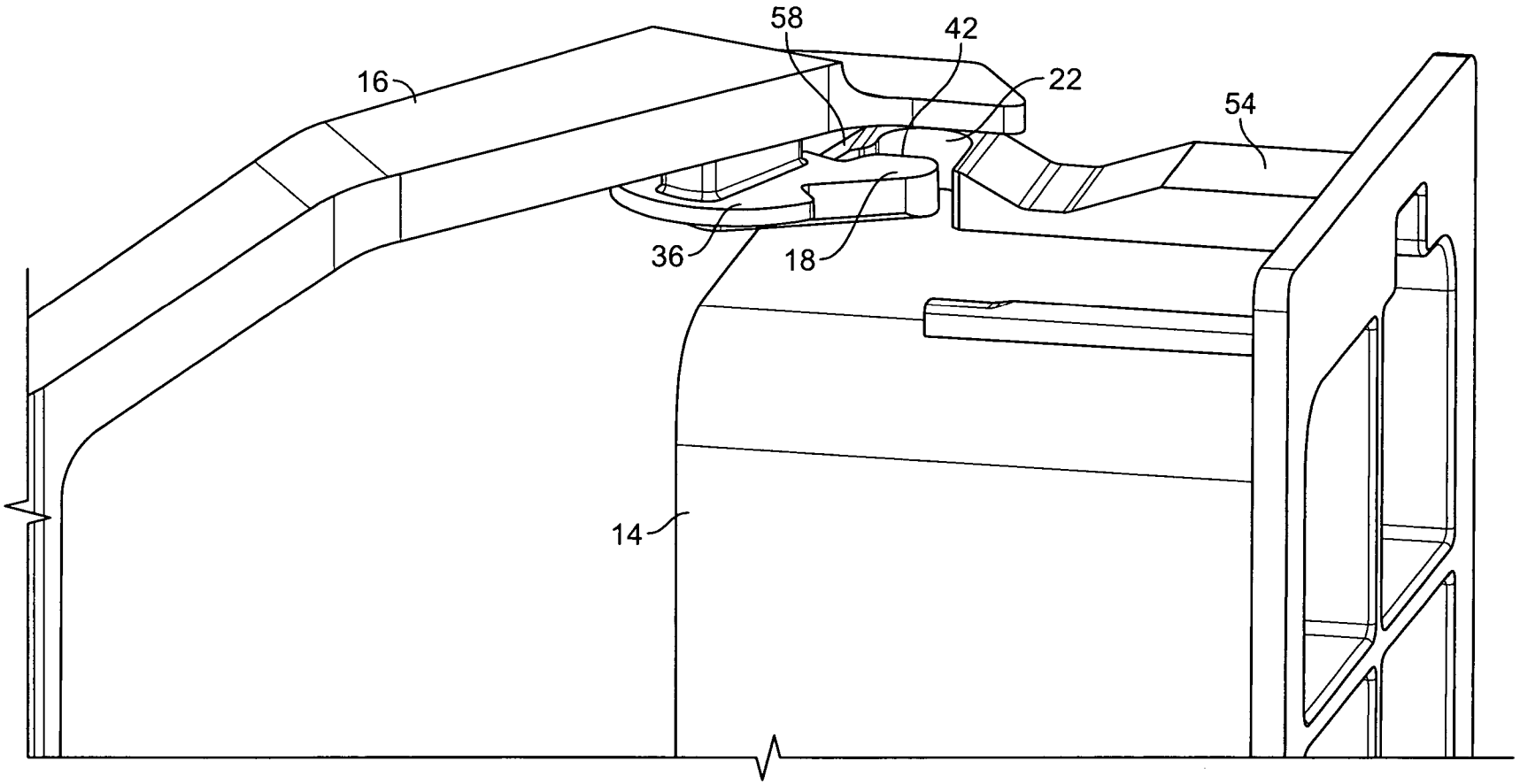
FIG. 10 is an enlarged perspective view of the connector assembly and the actuating lever after the second connector has been inserted linearly a distance into the first connector (not shown for clarity) showing the cam projection of the actuator lever configured to engage a cam groove or pocket of the second connector.

Once fully mated, the releasing projection 54 further includes a receiving pocket 61 that is sized to receive the blocking portion 50 once it shifts back to its original position as best shown in FIGS. 8 and 12. The receiving pocket 61 permits the blocking portion to generally be unstressed or unbiased when the connectors 12 and 14 are fully connected.

In order to linearly advance or urge the connectors 12 and 14 together into a mating relationship, the lever actuator 16 is pivoted by a user so that the cam projection 18 on the actuating lever 16 engages the cam groove 22 in the second connector 12 to linearly advance or urge the second connector 14 into the first connector 12 using a predetermined leveraged mechanical advantage provided by the lever actuator. In particular, such linearly advancement is achieved via the mechanical advantage obtained from the one or more predetermined force transmitting engagement portions 42 positioned on the lever actuator 16 and, in particular, positioned on the cam projection 18 thereof. As shown, the cam groove 22 is a straight groove or pocket, but it may alternatively take a curvilinear, angled, or stepped shape as well as other forms depending on the force requirements needed to engage and disengage the connectors.

Figure 13:
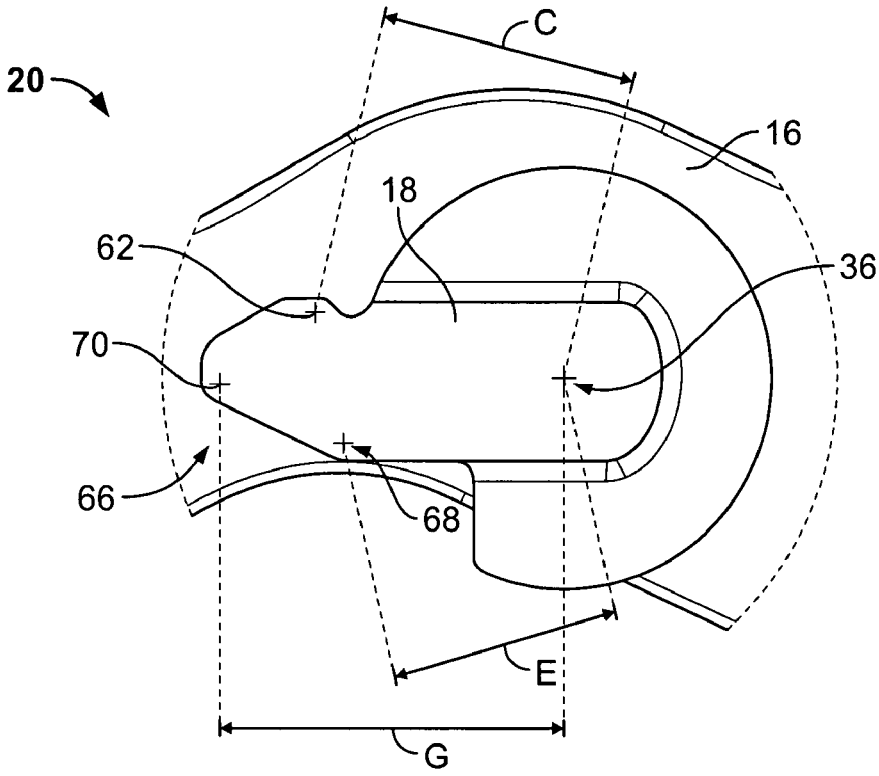
FIG. 13 is a partial elevational view of the actuating lever and cam projection thereof showing a plurality of predetermined force transmitting engagement portions.
Figure 14:
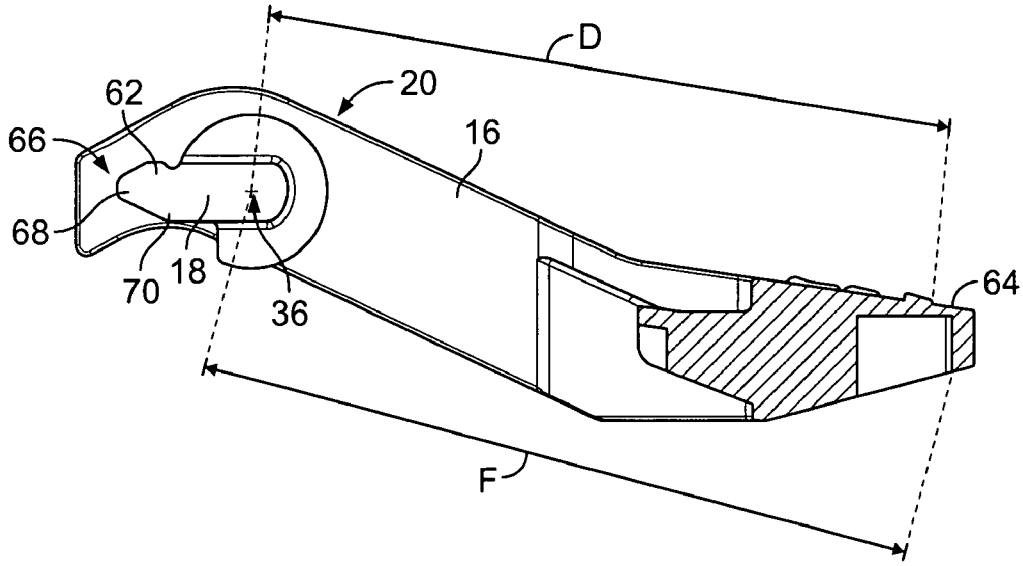
FIG. 14 is an elevational view of the actuating lever showing a force input end for applying an actuation force thereto to pivot the lever actuator, a pivot connection thereof, and the predetermined force transmitting engagement portions on the cam projection opposite the force input end.

Referring to FIGS. 13 and 14, one preferred embodiment of the lever actuator 16 and, in particular, the cam projection 18 thereof is illustrated in more detail. As described above, the cam projection includes one or more predetermined force transmitting engagement portions 42. More specifically, the cam projection 18 preferably includes at least one mating predetermined force transmitting engagement portion 62 on one side of the cam projection 18 and at least two un-mating predetermined force transmitting engagement portions 68 and 70 on an opposite side of the cam projection 18. Depending on the force requirements, however, more or less engagement portions may also be provided. Each predetermined force transmitting engagement portion is configured to provide a discrete, leveraged mating or un-mating force upon engagement with a surface of the cam groove 22 during pivoting of the lever actuator 16. By one approach, each engagement portion 62, 68, and/or 70 is in the form of a protrusion, knuckle, or other extension of the cam projection 18 that is positioned to engage the walls of the cam groove 22 generally without other surfaces of the cam projection 18 contacting the cam groove.

Turning to the mating sequence, the cam protrusion 18 includes the mating predetermined force transmitting engagement portion 62 positioned on the outer surface of the cam protrusion 18 a predetermined distance C from the pivot element 36 so that a predetermined leverage ratio LR1 is formed in relation to a predetermined distance D from the pivot element 36 to a user or force-input end 64 of the lever 16. In this manner, the leverage ratio LR1 (i.e., D:C) is provided that permits the lever actuator 16 to provide a mating force of at least about 300 N derived from a user input force of less than about 75 N. In one example, it is preferred that the leverage ratio LR1 is at least about 7:1 where the distance D is about 7× the distance C. In a preferred example, the distance C is about 6.6 mm and the distance D is about 48.2 mm to provide a leverage ratio LR1 of about 7.3:1.

Regarding the un-mating sequence, the cam projection 18 includes at least one un-mating predetermined force transmitting engagement portion 42 and, preferably, the cam projection 18 includes a pair of un-mating predetermined force transmitting engagement portions 42 (i.e., the protrusions 68 and 70). As a result, the lever 16 is configured to provide a sequential, dual stage leveraged output force upon applying substantially the same user input force to the force-input end 64 of the lever 16 during un-mating of the connector 10 (i.e., direction arrow H in FIG. 1). Turning again to FIGS. 13 and 14, the cam projection 18 includes a first un-mating force transmitting engagement portion 68 dimensioned relative to the force-input end 64 and pivot element 36 to provide an initial un-mating stage that generates a high level of output force. The cam projection 18 also includes a second un-mating force transmitting engagement portion 70 dimensioned a different distance relative to the force-input end 64 and pivot element 36 to provide a subsequent or second un-mating stage generating a lower lever of output force. In both stages of un-mating, the high and low level of output force is achieved upon a user applying substantially the same amount of input force to the force-input end 64 of the lever actuator 16.

More specifically, the first un-mating predetermined force transmitting engagement portion 68 is positioned a predetermined distance E from the pivot element 36 so that a predetermined leverage ratio LR2 is formed in relation to a predetermined distance F from the pivot element 36 to the user or force-input end 64 of the lever 16. In order to form the leverage ratio LR2 (i.e., F:E) that permits the lever actuator 16 to provide the first-stage or a high level of un-mating force (i.e., generally an un-mating force greater than about 300 N) derived from a user input force of less than about 75 N, it is preferred that the leverage ratio LR2 is at least about 8:1 where the distance F is at least about 8× the distance E. In one preferred embodiment, the distance E is about 5.7 mm and the distance F is about 50.5 mm to provide a leverage ration LR2 of about 8.8:1. This initial high level of un-mating force is beneficial in order to overcome the high frictional forces holding the connector housing together and the combined frictional forces holding the 90 or greater electrical connectors together.

During the continued un-mating sequence, once the initial frictional forces are overcome during un-mating, it is generally not necessary to continue to provide such high level of un-mating force. To this end, the lever cam projection 18 provides the second un-mating predetermined force transmitting engagement portion 70 positioned a different distance from the pivot element 36 than the first engagement portion 68. As a result, once the initial high level of frictional forces have been overcome, the cam projection 18 switches from the first stage (high level) to the second stage (low level) of un-mating where the same or less input force continues to un-mate the connectors with a lower lever of un-mating force.

More specifically, the second un-mating predetermined force transmitting engagement portion 70 is positioned a longer, predetermined distance G from the pivot element 36 so that a second, un-mating predetermined leverage ratio LR3 is formed in relation to the predetermined lever un-mating arm distance F to provide the lower level of output force. In order to form the leverage ratio LR3 (i.e., F:G) that permits the lever actuator 16 to providing a subsequent, lower level of un-mating force for the second or subsequent stage of un-mating (i.e., an un-mating force less than about 300 N) derived from the same user input force of less than about 75 N, it is preferred that the second stage of an un-mating leverage ratio LR3 is at least about 5:1 where the distance F is at least about 5× the distance G. In one preferred embodiment, the distance G is about 8.9 mm and the distance F is about 50.5 mm to provide a leverage ratio LR3 of about 5.6:1. As a result, with a larger distance G relative to the distance F, less mechanical advantage is obtained in the second stage of un-mating so that the same input force generates less output force to un-mate the connectors.

As mentioned above, such dual stage un-mating is advantageous because it permits an initial, high level of un-mate force to overcome the higher frictional and engagement forces holding the first and second connectors 12 and 14 together (including the forces holding the 90 or greater pin contacts together), but allows a subsequent, lower level of un-mating force to be applied upon further disengagement of the connectors 12 and 14 when such higher force levels are generally not needed because the frictional and engagement forces are lower. In the case of a connector having 90 or more pin contacts, the initial frictional forces holding this large number of connectors is much larger than the prior connectors that having less than half the number of contacts. Thus, the lever designs of the prior connectors generally can not efficiently mate and un-mate the large connector with input forces less than 75 N as generally required by automotive industry standards.

Figure 15:
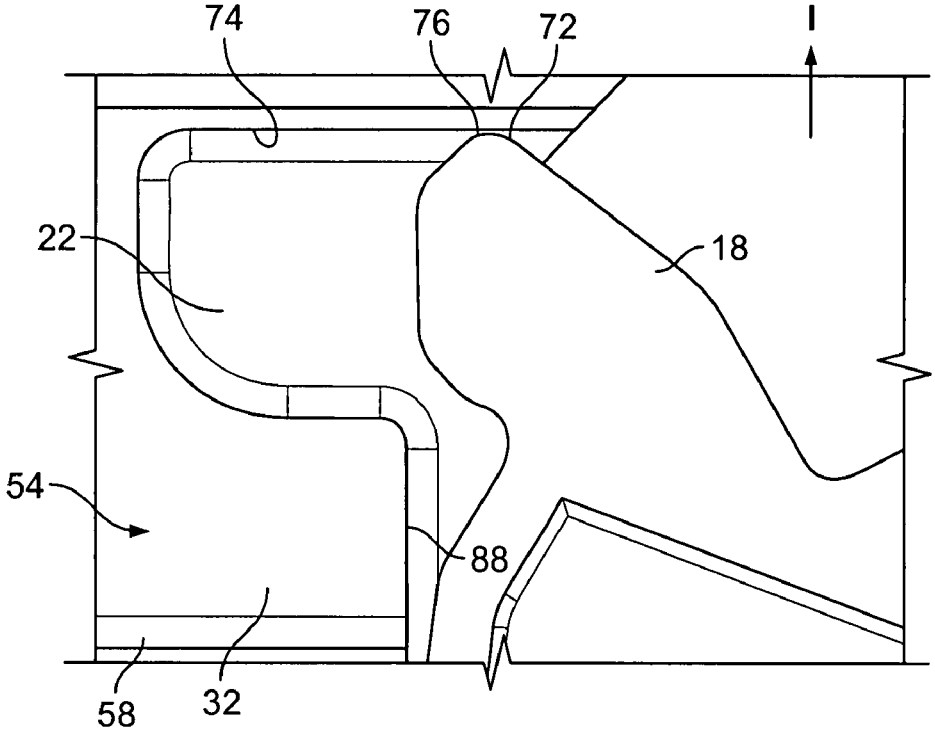
FIG. 15 is a elevational view of the lever cam projection in a pre-mate position relative to the cam groove showing an abutment surface and a drive surface of the second connector cam groove or pocket.

Turning to FIGS. 15 to 18, an exemplary mating sequence of the cam projection 18 and cam groove 22 is illustrated. FIG. 15 shows the cam projection 18 and cam groove 22 in the pre-mate position where a distal end 72 of the cam projection 18 engages an abutment edge or surface 74 of the cam groove 22. The abutment edge 74 of the cam groove 22 is a surface defining one boundary of the cam groove or pocket 22 that extends generally orthogonal to the linear insertion direction I (FIG. 15) of the connectors 12 and 14. The abutment edge 74 generally includes a stop portion 76 that is positioned to provide a hard stop to the insertion of the cam projection 18 as best shown by the engagement of cam projection distal end 72 against the abutment edge 74 in FIG. 15. At this point of the mating cycle, the user is signaled that the pre-mate position has been achieved and that further mating can be accomplished via shifting or pivoting of the lever actuator 16 because the cam projection 18 is positioned for engagement with the cam groove 22.

Figure 16:
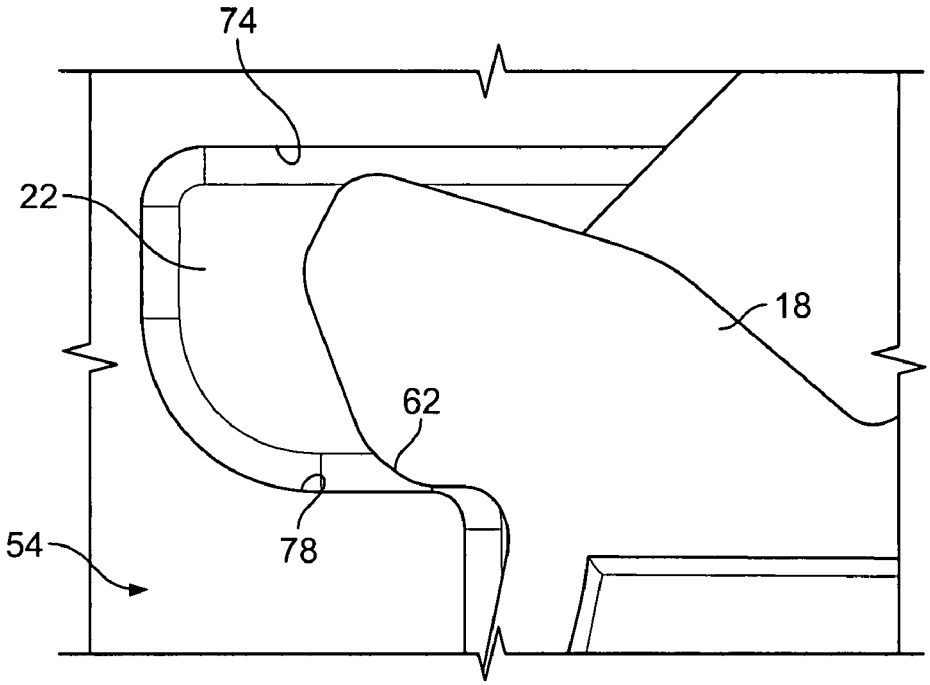
FIG. 16 is an elevational view of the lever cam projection shown approximately 20° into a mating sequence with a protrusion on the cam projection engaging the drive surface of the cam groove to linearly advance the second connector into a mating relationship with the first connector.
Figure 17:
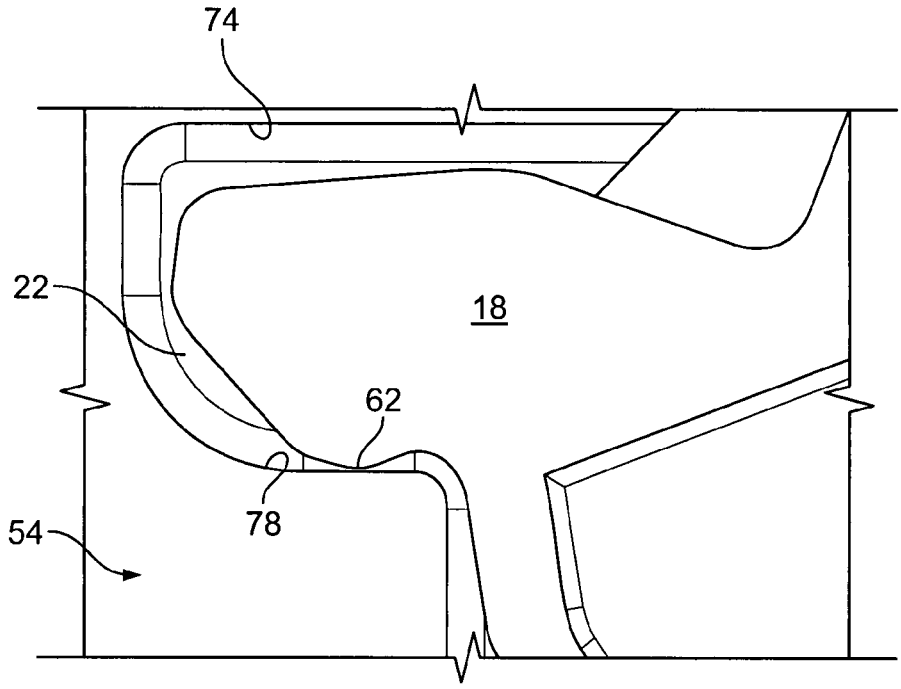
FIG. 17 is an elevational view of the lever cam projection shown approximately 40° into a mating sequence with the protrusion of the cam projection continuing to engage the drive surface of the cam groove.
Figure 18:
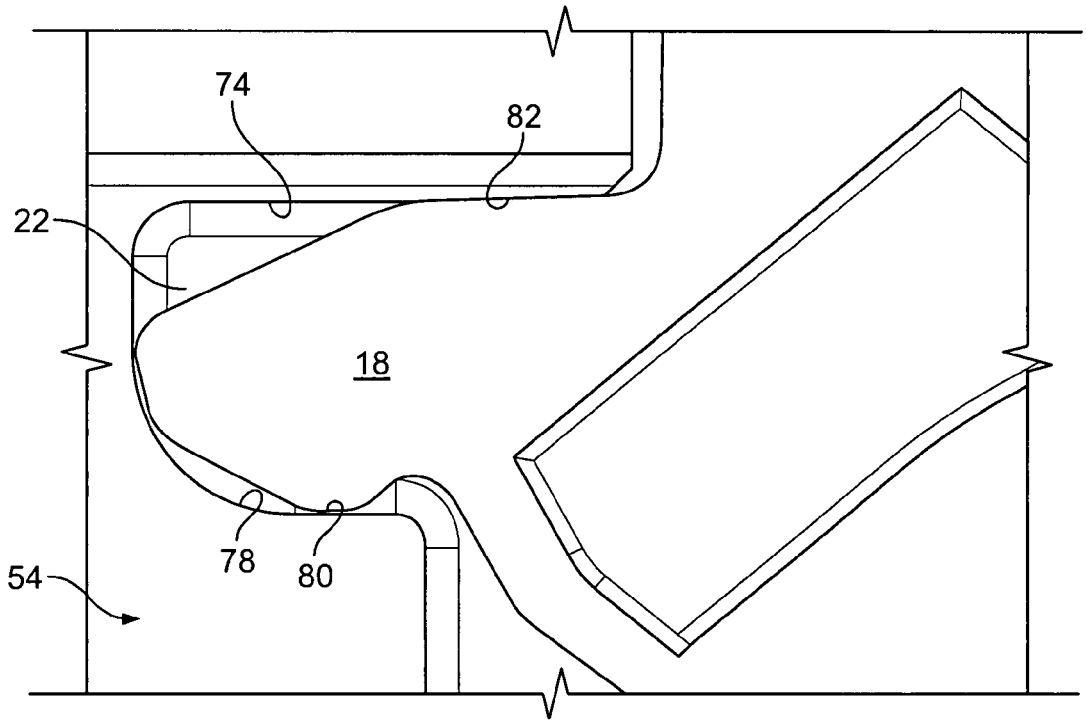
FIG. 18 is an elevational view of the lever cam projection shown in the mated position with opposing flats of the cam projection engage corresponding portions of the abutment and drive surfaces of the cam groove.

Next, FIG. 16 shows the lever actuator 16 shifted or pivoted about 20° into the mate sequence where the mating predetermined force transmitting engagement portion 62 engages a drive edge 78 of the cam groove 22. The drive edge 78 of the cam groove 22 is on the opposite side of the groove 22 from the abutment edge 74 and provides a drive surface for the mating predetermined force transmitting engagement portion 62 to apply a leveraged force thereto to advance the second connector 14 in a mating engagement with the first connector 12. Upon further shifting of the lever, FIG. 17 shows the lever actuator 16 shifted or pivoted about 40° into the mate sequence where the same mating predetermined force transmitting engagement portion 62 is still engaging the drive edge 78 for continued urging of the connectors 12 and 14 together. Upon continued shifting or pivoting of the actuating lever 16, the interaction of the cam groove 22 and the cam projection 18 draws the second connector 14 into full engagement with the first connector 12 where the lever actuator 16 is in the second or mated position. FIG. 18 shows the cam projection 18 and the cam groove 22 in this fully mated position where the second connector 14 is fully received with the first connector 12. In such position, opposing flats 80 and 82 on opposite sides of the cam projection 18 help secure the cam projection 18 in this mated position. That is, for example, flat 80 abuts against the drive surface 78 and flat 82 abuts against the abutment surface 74. As discussed previously, when the lever actuator 16 is in the second or mated position, the latch member 24 on the center connecting portion 34 of the lever actuator 16 engages a cooperative lock member 26 on the first housing 12 to secure the lever actuator 16 in the second position.

During the mating sequence, the cam projection 18 is preferably configured to have a single or discrete engagement portion that contacts the cam groove drive surface 78. Preferably, the single engagement portion contacts this drive surface throughout the mating sequence to provide a discrete and constant level of leveraged mating force. This single engagement portion is in contrast to prior connectors that include engagement surfaces or curved cam portions that provide a rolling or variable engagement between the cam and groove during the mating sequence, which also provide a variable amount of mating force depending on the position of the various cam surfaces. In this case, the single engagement portion during mating provides a constant and increased level of mating force suitable to mate the above described large connectors.

Figure 19:
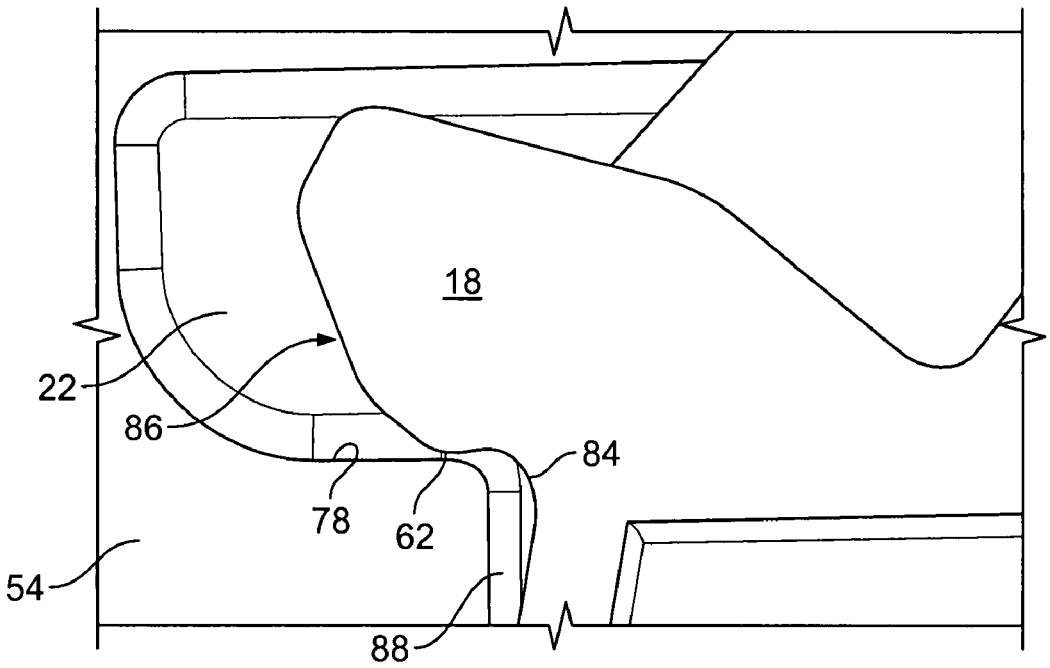
FIG. 19 is an elevational view of the lever cam projection shown approximately 20° into a mating sequence with a undercut corner area thereof positioned to provide clearance so that only the protrusion of the cam projection engages the drive surface of the cam groove.

As best shown in FIG. 19, the single predetermined engagement portion 62 contacts the drive surface 78 during the mating sequence because the cam projection 18 preferably includes a valley or undercut corner area 84 adjacent the engagement portion 62. The predetermined positioning of the undercut corner 84 adjacent the knuckle 62 is selected, so that during the mating sequence, generally only the portion 62 contacts the drive surface 78 to provide the desired mating force rather than other portions of the cam projection 18. Indeed, if the undercut corner area 84 was not present, other undesired areas of the projection 18 may contact the drive surface and less than the desired mating force could be obtained.

To facilitate the insertion of the cam projection 18 past the release projection 54, the cam projection 18 preferably includes a truncated corner or flat edge 86 adjacent the distal end 72 and generally extending between the distal end 72 and the engagement portion 62. This flat surface 86 is positioned to permit the cam projection 18 to more easily slide across and clear an upper edge 88 of the release projection 54 with little or no frictional engagement upon the initial insertion of the second connector 14 into the first connector 12. In this manner, the cam projection 18 is configured to linearly advance along the upper surface 88 of the release projection 54 with little or no interference in order to reach the cam groove 22.

Turning to the un-mating sequence, the lever actuator 16 must first be unlatched from the lock member 26 by depressing the resilient tab 28 to provide clearance for the reverse shifting or pivoting of the lever actuator 16. Thereafter, the lever actuator 16 is free to move in an un-mating direction H (FIG. 1) by shifting or pivoting the lever actuator 16 in the un-mating direction. With such reverse motion of the lever actuator 16, the interaction between the cam groove 22 and the cam projection 18 urges or linearly separates the first connector 12 and the second connector 14 allowing the connectors to be unmated. As further described below, it is preferred to employ the dual stage un-mating sequence with an initial high level of un-mating force and a subsequent lower level of un-mating force to accomplish the un-mating of the connectors 12 and 14.

Figure 20:
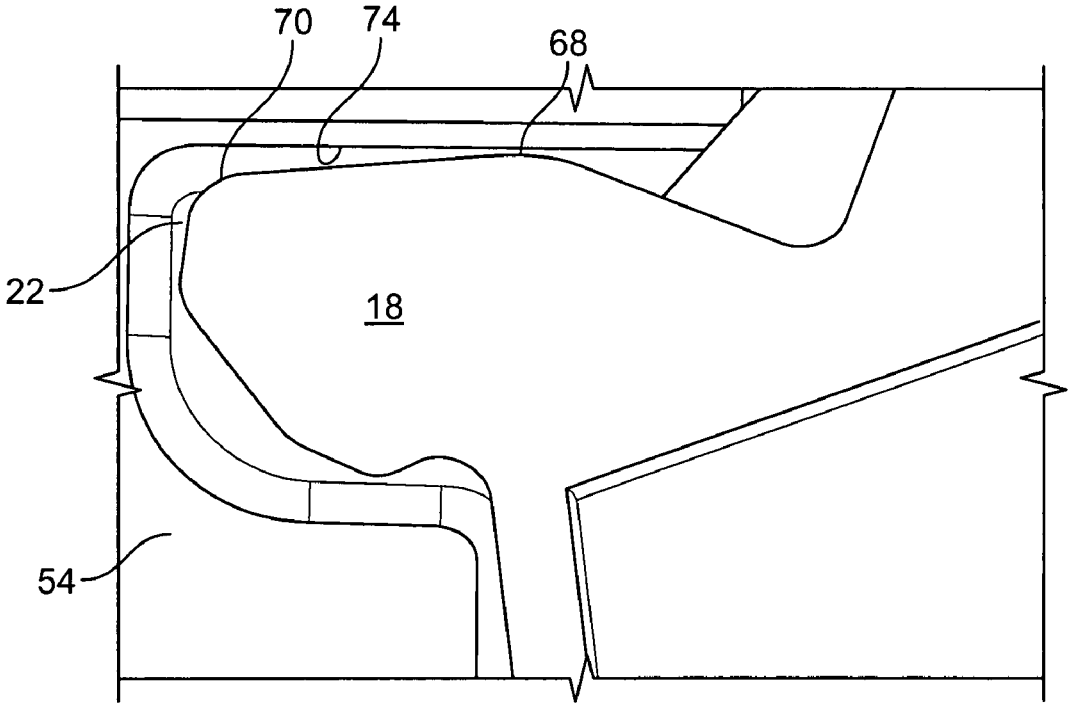
FIG. 20 is an elevational view of the lever cam projection shown approximately 20° into an un-mating sequence showing a first, un-mating predetermined force transmitting engagement portion engaging the abutment surface to provide an initial or high level of un-mating output force to disengage the second connector from the first connector.
Figure 21:
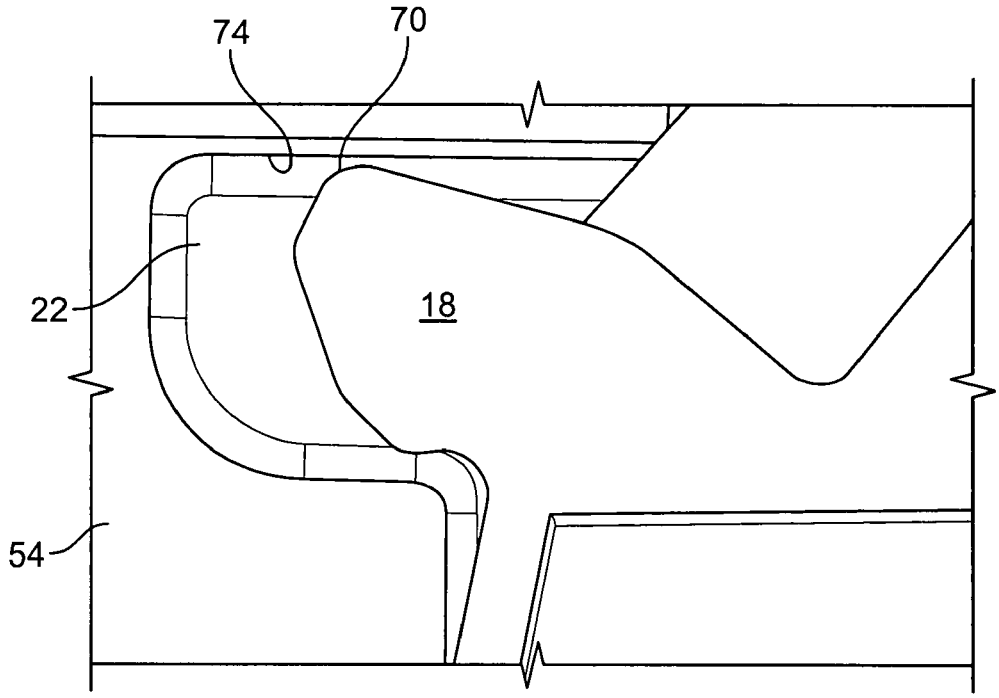
FIG. 21 is an elevational view of the lever cam projection shown approximately 40° into an un-mating sequence showing a second, un-mating predetermined force transmitting engagement portion engaging the abutment surface to provide a subsequent or lower level of output force to continue the disengagement of the second connector from the first connector.

Turning to FIGS. 20 and 21, the dual-stage un-mating sequence is illustrated in more detail. To begin with, as the lever actuator 16 is shifted in the un-mating direction H about 20°, the cam projection 18 is shifted by an amount so that the first un-mating force transmitting engagement portion 68 contacts the abutment surface 74 to provide the first stage of un-mating force. As discussed above, this first un-mating engagement portion 68 is positioned to provide a high level of un-mating force to overcome the initial frictional and engagement forces between the connectors 12 and 14. In this configuration of the un-mating sequence, the second un-mating force transmitting engagement portion 70 is spaced from the first engagement portion and not contacting the groove walls as shown in FIG. 20.

Upon further pivoting of the actuation lever 16, the cam projection 18 reaches the general position illustrated in FIG. 21, which is about 40° into the un-mate sequence. In this position, the second un-mating force transmitting engagement portion 70 now contacts the abutment surface 74. As discussed above, this second un-mating engagement portion 68 is positioned to provide a lower level of un-mating force. In this position, the first engagement portion 68 is spaced from the second engagement portion 70 and not contacting the groove walls as best shown in FIG. 21. Upon further pivoting of the actuating lever 16 in the un-mating direction, the lever reaches the pre-mate position of FIG. 15, where the first and second connectors can then be manually separated. The connector 10 is now ready to be re-assembled following the mating procedures previously described.

Figure 22:
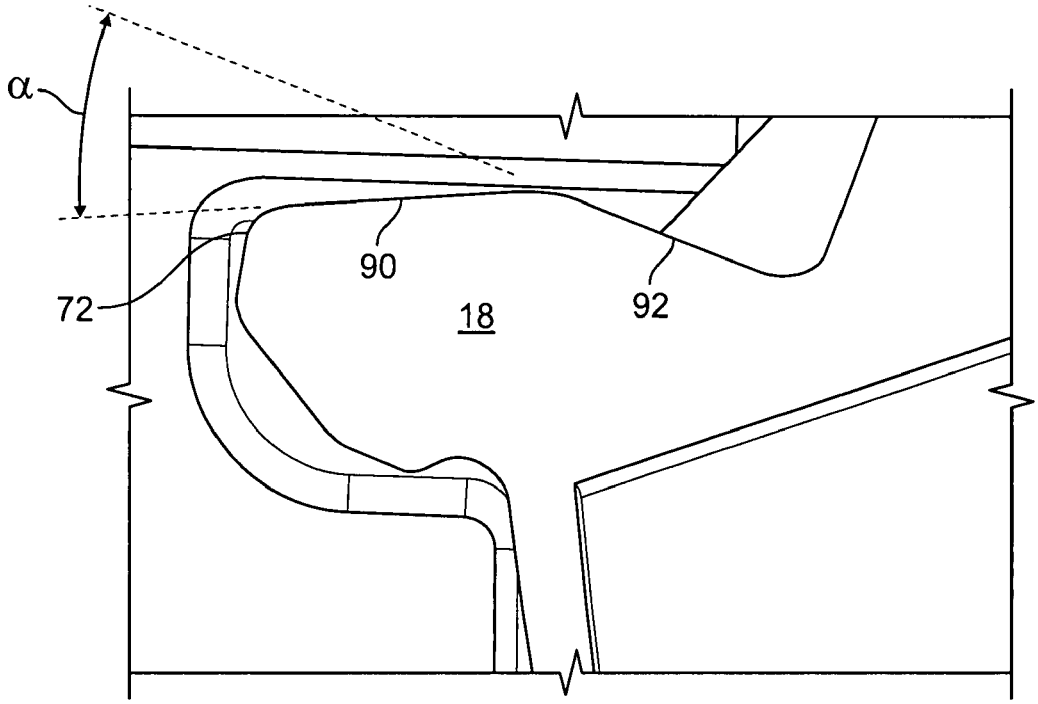
FIG. 22 is an enlarged, elevational view of the lever cam projection shown in the mated position having an inclined flat surface and a clearance at the end of the cam projection providing the engagement of the first, un-mating predetermined force transmitting engagement portion.

Similar to the mating sequence, the un-mating sequence is configured to provide discrete leveraged forces. During un-mating, however, it is preferred that at least two discrete and constant un-mating forces supplied via the dual stage un-mating sequence be employed. This dual-stage leveraged force is also in contrast to the variable un-mating forces achieved from prior art camming surfaces that employ curved surfaces. Turning to FIG. 22, to achieve the discrete leveraged forces that are applied in the dual stages, the cam projection 18 further includes an inclined surface 90 extending toward the cam projection distal end 72 between the first and second un-mating force transmitting engagement portions 68 and 70, respectively. The inclined surface 90 is angled so that upon pivoting of the lever actuator 16, the cam projection 18 is permitted to rotate within the cam groove 22 and also permits either the first or second un-mating force transmitting engagement portion 68 or 70 to separately engage the abutment surface 74 in order to provide the discrete and constant un-mating forces. In one embodiment, the inclined surface 90 is angled a about 20 to about 30° relative to an upper surface 92 of the cam projection 18.

As a result, the connector assembly 10 and actuator lever 16 are configured to provide a more robust assembly that is suitable to mate and un-mate large electrical connectors that include 90 or more pin contacts. It will be appreciated, however, that while the assembly 10 is particularly preferred for such large connectors, the connector assembly 10 and lever 16 are also suitable for connector configurations with more or less pin contacts. It will be further understood that the electrical connectors may be embodied in other specific forms without departing from the spirit or central characteristics thereof. The present examples and embodiments, therefore, are to be considered in all respects as illustrative and not restrictive, and the electrical connector is not to be limited to the details given herein.

What is claimed is:

1. An electrical connector assembly comprising:

first and second electrical connectors including respective first and second connector housings for being mated together;

an actuating lever mounted to the first electrical connector for being shifted to mate the connectors together, the actuating lever having a predetermined first position with the connectors unmated and a predetermined second position with the connectors fully mated;

a cam projection of the actuating lever;

a cam groove of the second connector with the cam projection and groove configured to engage so that shifting of the actuating lever from the first position to the second position causes the connectors to fully mate with each other;

a blocking portion formed on the first connector housing and extending into the first connector housing in interference with the cam projection for releasable retaining the actuating lever in the first position; and a release portion formed on the second connector housing operable to shift the blocking portion outwardly to a clearance position to allow the actuating lever to be shifted from the first position to the second position with the cam projection received in the cam groove.

2. The electrical connector assembly of claim 1 wherein said blocking portion is adjacent the cam projection on an inner surface of the first connector housing and the release portion is adjacent the cam groove on an outer surface of the second connector housing.

* * * * *

UNITED STATES PATENT AND TRADEMARK OFFICE

CERTIFICATE OF CORRECTION

PATENT NO. : 7,396,242 B2
APPLICATION NO. : 11/811086
DATED : July 8, 2008
INVENTOR(S) : Kurt P. Dekoski, David M. Langolf and Thomas Dolinshek It is certified that error appears in the above-identified patent and that said Letters Patent is hereby corrected as shown below:

In Column 14, after line 29 claims 2, 3 and 4 should be inserted:
--2. The electrical connector assembly of claim 1 wherein the blocking portion and the release portion include cooperating cam surfaces that cammingly engage each other for shifting of the blocking portion.
3. The electrical connector assembly of claim 1 wherein the blocking portion comprises a thin wall portion of the first connector.
4. The electrical connector assembly of claim 1 wherein the blocking portion comprises a resilient portion of the first connector.--.

In Column 14, line 30 “2” should be --5--.

Signed and Sealed this

Fourteenth Day of July, 2009

John Doll

JOHN DOLL
*Acting Director of the United States Patent and Trademark Office*